US005441686A

United States Patent [19]

Jackl et al.

[11] Patent Number: 5,441,686

[45] Date of Patent: Aug. 15, 1995

[54] METHOD OF FORMING AND ASSEMBLING TOP SHELLS ONTO THE LINKS OF METALLIC WATCHBANDS

[75] Inventors: Werner Jackl, Coventry, R.I.; Richard E. Ripley, Atteboro, Mass.

[73] Assignee: Textron Inc., Providence, R.I.

[21] Appl. No.: 169,333

[22] Filed: Dec. 17, 1993

[51] Int. Cl.[6] ..... B29C 65/64

[52] U.S. Cl. ..... 264/152; 29/469.5; 29/505; 59/79.3; 59/82; 63/5.1; 224/175; 264/163; 264/249; 425/302.1; 425/510

[58] Field of Search ..... 425/289, 301, 302.1, 425/510, 112; 264/138, 152, 157, 163, 249; 29/469.5, 505; 59/80, 82, 79.1, 79.2, 79.3; 63/5.1; 224/164, 173, 175

[56] References Cited

U.S. PATENT DOCUMENTS

| | | | |
|---|---|---|---|
| 3,416,305 | 12/1968 | Rieth | 224/175 |
| 3,625,001 | 12/1971 | Levinger | 63/5.1 |
| 3,844,136 | 10/1974 | Rieth et al. | 224/173 |
| 3,994,126 | 11/1976 | Rieth | 63/5.1 |

FOREIGN PATENT DOCUMENTS

| | | | |
|---|---|---|---|
| 0570638 | 11/1993 | European Pat. Off. | 63/5.1 |
| 2302829 | 10/1976 | France | 249/115 |
| 52-26868 | 2/1977 | Japan | 264/138 |

*Primary Examiner*—Jay H. Woo
*Assistant Examiner*—Duane S. Smith
*Attorney, Agent, or Firm*—Samuels, Gauthier & Stevens

[57] ABSTRACT

A method of assembling top shells onto the links of a flexible linkage, the top shells being configured and dimensioned to overlie the links and having bendable end tabs. The method includes the steps of: forming an elongated framework which includes a plurality of the top shells arranged in an integrally interconnected parallel array; combining a section of the linkage with the top shell framework in a manner such that the links are aligned with the top shells; and subdividing the framework to separate the top shells one from the other in connection with the deformation of the end tabs around and into mechanical interengagement with the ends of the links to thereby secure the top shells to the links.

15 Claims, 5 Drawing Sheets

METHOD OF FORMING AND ASSEMBLING TOP SHELLS ONTO THE LINKS OF METALLIC WATCHBANDS

BACKGROUND OF THE INVENTION

1. Field of the Invention

This invention relates generally to flexible linkages of the type employed in watchbands, and is concerned in particular with an improved method of forming and mounting top shells onto the links of such linkages.

2. Description of the Prior Art

The invention is particularly suited for, although not limited in use to, the mounting of molded plastic top shells onto the top links of metallic expansible watchband linkages. The conventional expansible watchband typically includes a row of top links overlying a row of bottom links. The top links have hollow box-like configurations with open ends. Each bottom link is connected to two adjacent top links by pairs of U-shaped staples. Springs housed in the links coact with the staples to yieldably contract the band. The top and bottom links as well as the staples and springs are typically fabricated as metal stampings. Top shells, also typically fabricated as metal stampings, are applied to the top links to impart the desired ornamental appearance to the finished product.

Because of their relatively thin-walled constructions, stamped metallic top shells contribute only minimally to the overall weight of the finished product. In some cases, this has led to expansible watchbands being compared unfavorably to more expensive non-expansible bands, which characteristically rely on thicker and heavier links, usually produced as castings or machined components.

During the assembly process, the stamped metallic top shells are conventionally batch loaded into vibrating hoppers, from which they are fed along tracks to a work station for application separately to individual top links of the expansible band. As a result of rubbing against one another in the vibrating hoppers, as well as against the guide surfaces of the feed tracks, the metallic top shells inevitably experience surface scratching. However, this is of little practical import because the top shells must in any event undergo expensive post assembly polishing to remove stretch marks which inevitably result from their origination as three dimensional stampings from flat sheet stock.

The stamped metallic top shells also require precise orientation and alignment preparatory to being applied separately to individual top links. The complexities involved in doing so on a mass production scale make it difficult and in most cases impractical to apply more than two top shell designs to a particular band.

Recent developments in expansible watchband technology have demonstrated the feasibility of substituting non-metallic top shells, in particular those molded of plastic materials such as LEXAN and the like, for the conventional stamped metallic top shells. From the designer's standpoint, all plastic top shells open new windows of opportunity, including the introduction of vibrant colors and heretofore unachievable shapes and contours. From the manufacturing standpoint, beneficial savings can be realized because the plastic top shells exit the molds without surface blemishes which require post assembly polishing.

An object of the present invention is to capitalize still further on the use of plastic top shells by providing an improved more cost effective method of forming and applying them to the top shells of expansible watchbands.

A companion objective of the present invention is the provision of an improved method of forming and applying top shells which is advantageously useful not only for non-metallic molded top shells, but also for metallic top shells produced as castings or stampings.

Still another objective of the present invention is the provision of a method of forming differently designed top shells and of applying them in any selected combination and on a mass production scale, thereby making it possible to achieve heretofore unattainable decorative motifs which vary along the length of the watchband.

SUMMARY OF THE INVENTION

The method of the present invention includes initially forming an elongated framework having a plurality of top shells arranged in an integrally interconnected parallel array. A section of watchband linkage is combined with the top shell framework in a manner such that individual links of the linkage are aligned with individual top shells. The framework is then subdivided to separate the top shells one from the other and to apply them to the respective links of the linkage.

In a preferred embodiment of the invention to be hereinafter described in greater detail, the framework comprises a plastic molding and the watchband is of the metallic expansion type. The framework consists of two parallel side rails having a plurality of top shells extending transversely therebetween, with the ends of each top shell being joined to respective side rails by integral ends tabs. During assembly, a section of the expansible watchband linkage is arranged between the side rails of the framework, with the top links of the linkage aligned with the top shells and extending between their respective ends tabs. The end tabs are then severed from the side rails and simultaneously bent around and into mechanical interengagement with the ends of respective top links, thereby completing a simultaneous assembly of all of the top shells of the framework onto a like number of the top links of the watchband linkage.

Preferably, the top shells are molded with recesses on the undersides thereof, and the top links are nested in the recesses of respective top shells prior to severing and bendably deforming the end tabs.

The top shells are advantageously arranged in a laterally spaced relationship within the molded framework, with the linkage being expanded sufficiently to align the top links with the thus spaced top shells.

The end tabs are severed and bendably deformed by coacting cutting blades which are operated simultaneously from opposite sides of the molded framework.

The top shells of each molded framework need not be identical, but instead may vary in color, shape, surface finish, etc. Thus, it becomes possible to provide bands with top shells which vary in design from end to end as well as from link to link.

These as well as other objects and advantages will become more apparent as the description proceeds with reference to the accompanying drawings, wherein:

DETAILED DESCRIPTION OF PREFERRED EMBODIMENTS

Figure 1:
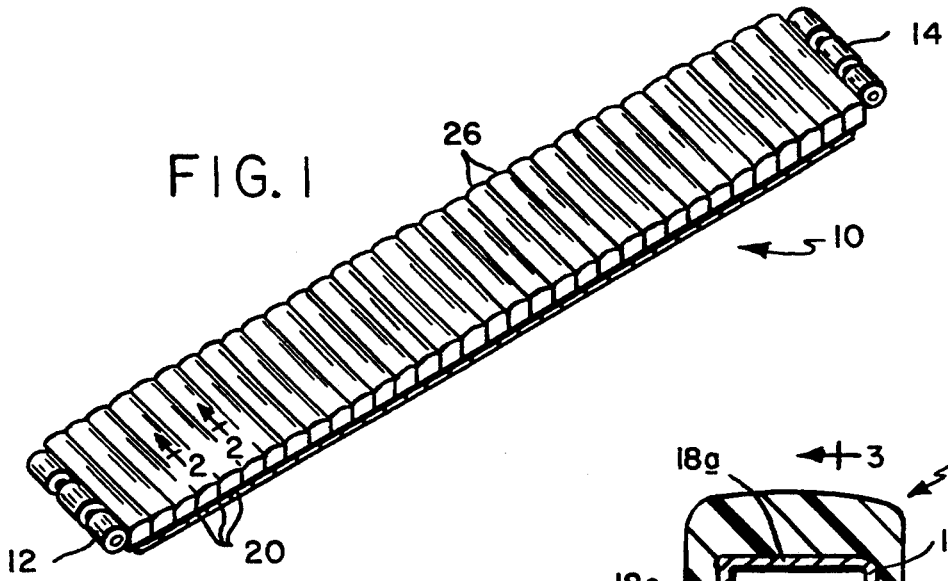
FIG. 1 is a perspective view showing an expansible watchband with plastic top shells molded and assembled in accordance with the present invention.
Figure 2:
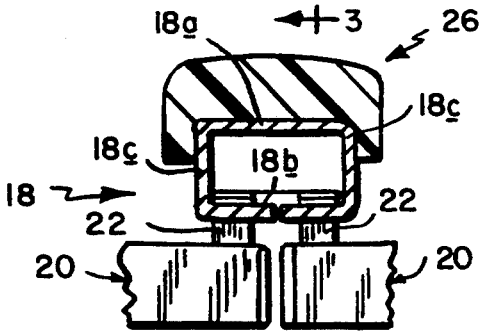
FIG. 2 is a sectional view on an enlarged scale taken along line 2—2 of FIG. 1.
Figure 3:
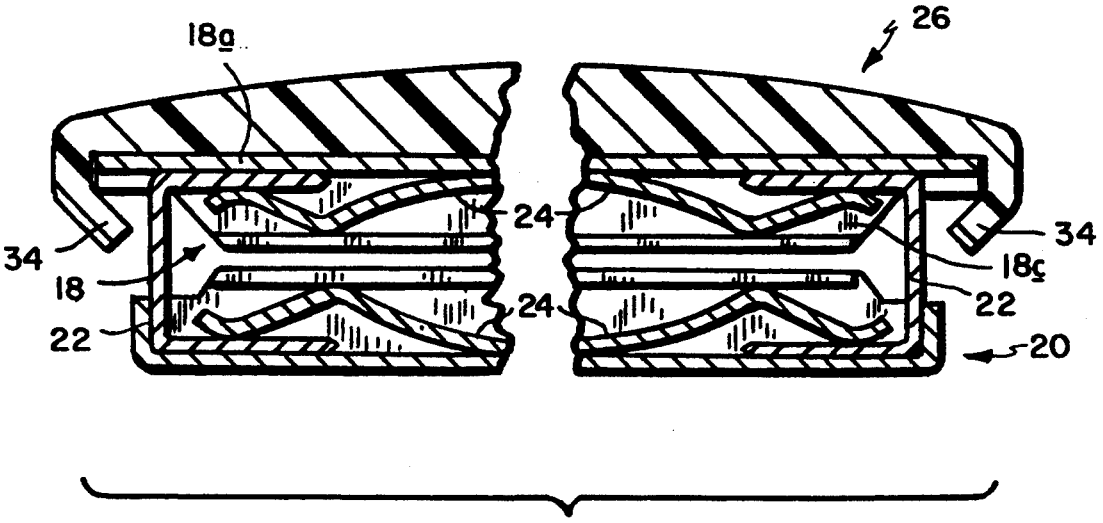
FIG. 3 is a sectional view taken along lines 3—3 of FIG. 2.

Referring initially to FIGS. 1-3, an expansible watchband 10 is shown with end connectors 12 and 14 designed to connect the watchband to a watch case (not shown). The watchband is of known construction, comprising a row of top links 18 overlying a row of bottom links 20. Each bottom link 20 is connected to two top links 18 by means of opposing pairs of U-shaped staples 22, the latter being acted upon by leaf springs 24 housed in the links. The leaf springs coact in resilient engagement with the staples to accommodate longitudinal expansion and contraction of the band in a manner well known to those skilled in the art.

The top links 18 have a hollow box-like configuration defined by top and bottom walls 18*a*, 18*b* and side walls 18*c*, with open ends extending laterally beyond the ends of the bottom links. The top links 18 are covered by decorative top shells 26. The top and bottom links 18, 20 and the staples 22 and springs 24 are all fabricated as metallic stampings, whereas the top shells 26 are molded entirely of a plastic material.

With reference additionally to the remaining drawings, it will be seen that the top shells 26 are molded as integral parts of an elongated plastic framework generally indicated at 28. The framework includes two parallel side rails 30 with the top shells 26 extending transversally therebetween. The top shells are preferably molded with recesses 32 on their undersides, and with end tabs 34 integrally joining the top shells to the side rails 30.

Figure 7:
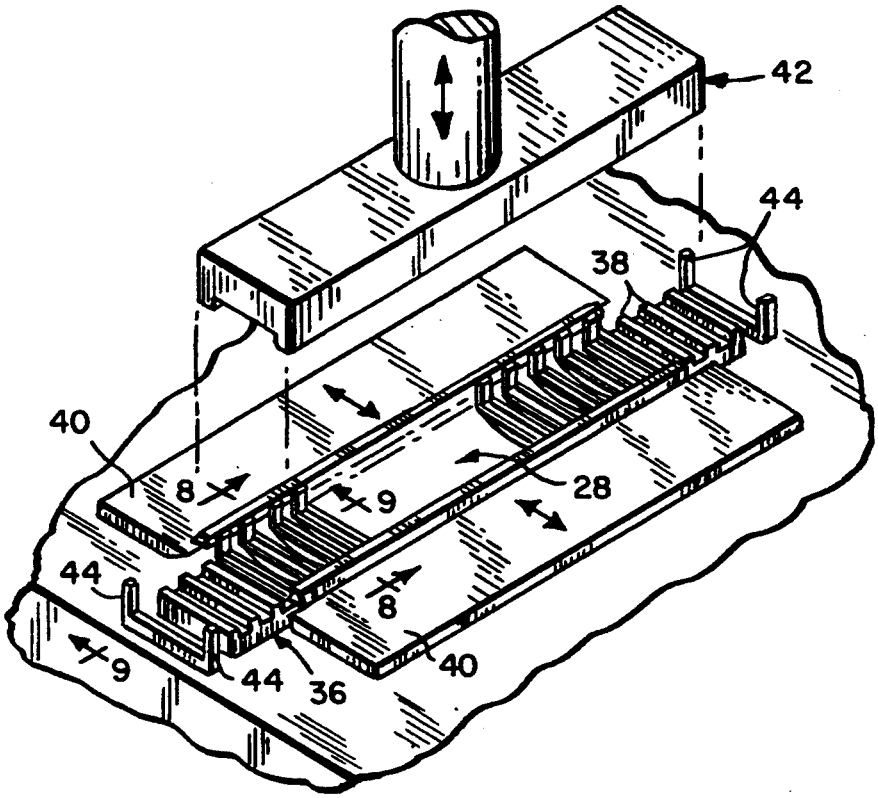
FIG. 7 is a perspective view of a work station and its associated tools and fixtures during one stage in the assembly method of the present invention.
Figure 8:
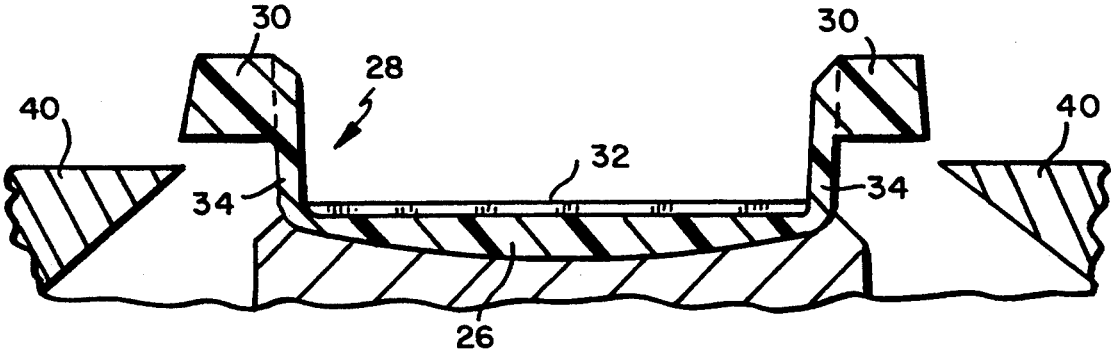
FIGS. 8 and 9 are sectional views on an enlarged scale taken respectively along lines 8—8 and 9—9 of FIG. 7.
Figure 9:
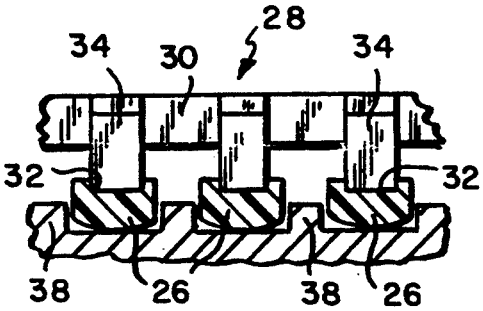

Assembly of the top shells 26 onto the top links 18 of a watchband is accomplished at a work station of the type depicted in FIG. 7. The work station has a stationary rack 36 defining a succession of upstanding teeth 38 with spaces therebetween. The rack 36 extends between two blades 40 which are shiftable simultaneously in opposite directions with respect to the rack 36. Blade shifting is accomplished by conventional piston-cylinder units (not shown). A vertically adjustable hold down device 42 overlies the rack 36.

Assembly of the plastic top shells 26 onto the top links 18 of a watchband is accomplished in the following manner: a molded top shell framework 28 is placed on the rack 36 as depicted in FIG. 7. When thus positioned, the individual top shells lie in inverted positions in the spaces between the teeth 38 of the rack, and the side rails 30 lie in a plane above that of the operating range of the opposed blades 40.

Figure 11:
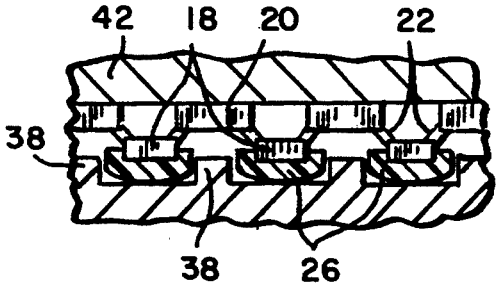
FIG. 11 is a sectional view taken along line 11—11 of FIG. 10.
Figure 10:
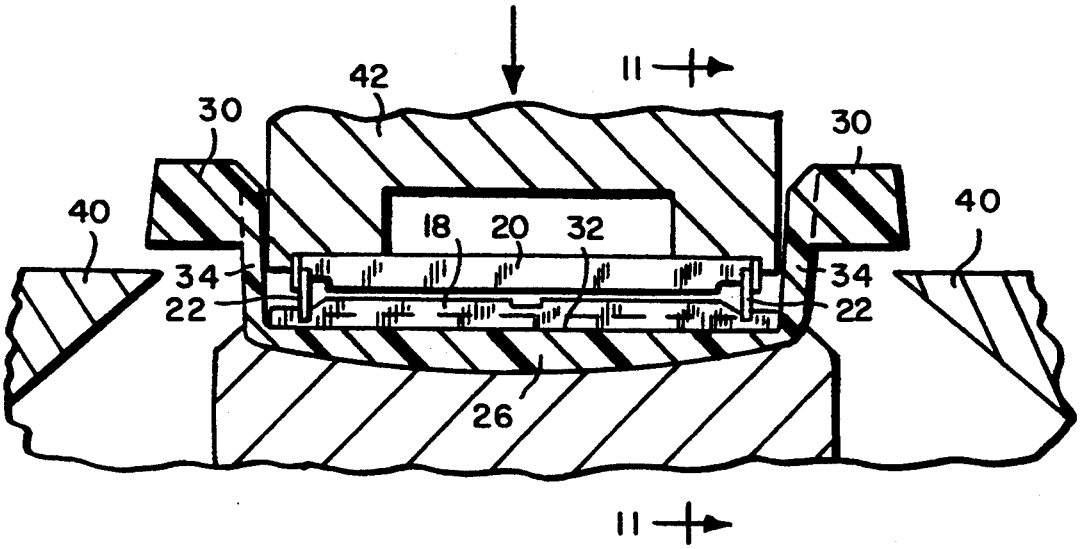
FIG. 10 is a view similar to FIG. 8 showing a subsequent stage in the assembly method.

Next, as shown in FIGS. 10 and 11, an inverted watchband linkage is placed between the side rails 30. The linkage is stretched and held between upstanding posts 44 at each end of the rack 36, with the extent that the linkage is stretched being gauged to locate individual top links 18 over respective underlying top shells 26. The hold down device 42 is then lowered to press the linkage downwardly, thereby firmly and positively seating each top link 26 in the recess 32 of the underlying top shell 26, with the ends of each top link being located between the end tabs 34.

Figure 12:
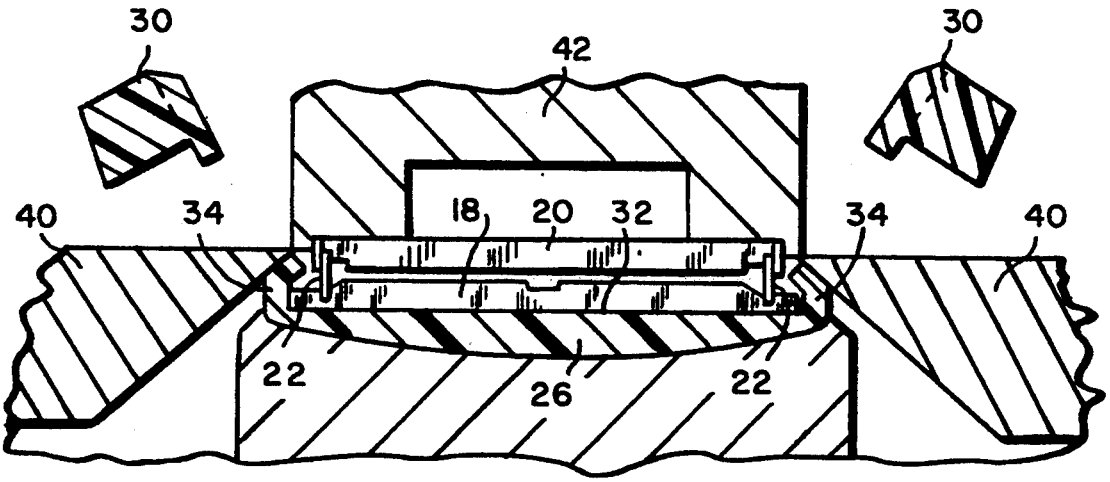
FIG. 12 is a sectional view similar to FIGS. 8 and 10 showing a still further stage in the assembly method.

Next, as shown in FIG. 12, the blades 40 are advanced to sever the end tabs 34 from the side rails 30 and to simultaneously bend and permanently deform the end tabs into mechanical interengagement with the ends of the top links 18 extending therebetween. This results in the top shells 26 being securely mounted on the top links 18 of the watchband.

In light of the foregoing, it will be seen that throughout the assembly procedure, the top shells 26 are not subjected to potentially damaging sliding contact with each other or with the guide surfaces of feed tracks. Instead, the top shells are maintained in a mutually spaced relationship until secured to the top links and are thus safeguarded from surface scratching.

Figure 13:
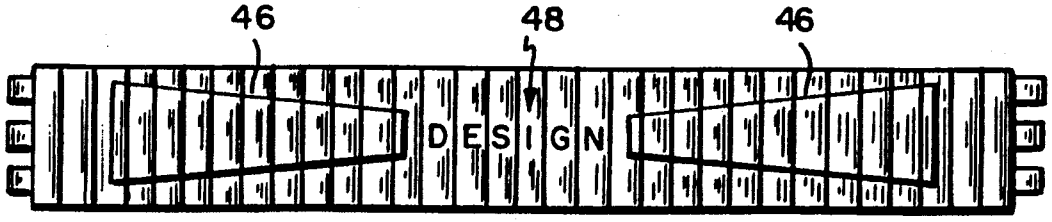
FIGS. 13 and 14 are top plan and side elevational views respectively of a watchband incorporating differently designed top shells.
Figure 14:
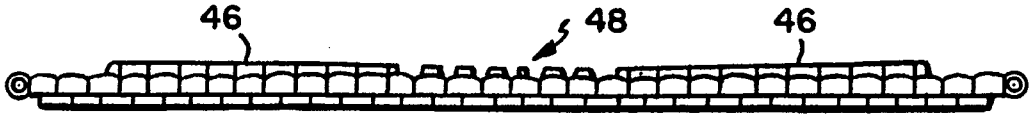
Figure 15:
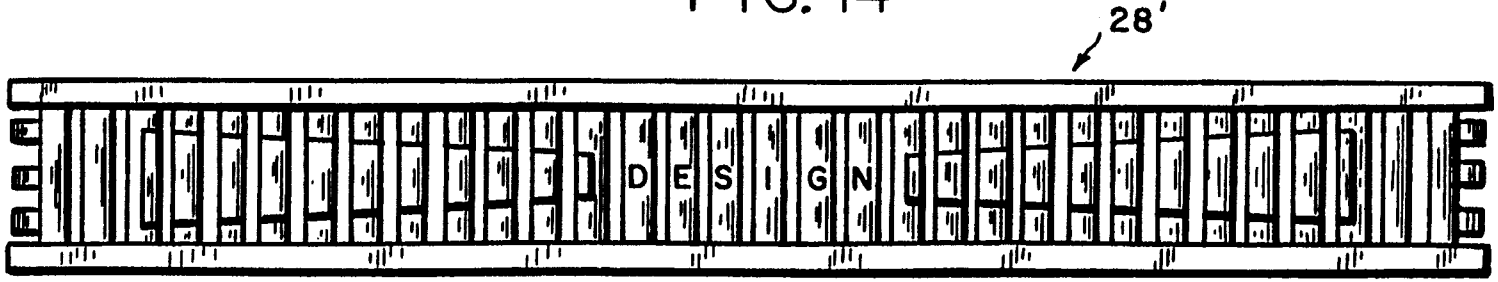
FIG. 15 is a top plan view of the molded framework of top shells required to yield the design shown in FIGS. 13 and 14.

Another advantageous feature of the present invention relates to its adaptability to the assembly of differently designed and shaped top shells on a single watchband. For example, as shown in FIGS. 13 and 14, differently designed top shells can be combined to provide the band with raised tapered areas 46 of varying thickness, as well as various indicia 48. FIG. 15 illustrates a typical molded framework 28′ required to accomplish the foregoing. Although the individual top shells 26 differ one from the other, their simultaneous application to the top links 18 of a watchband can easily and efficiently be effected with the above described method.

Figure 4:
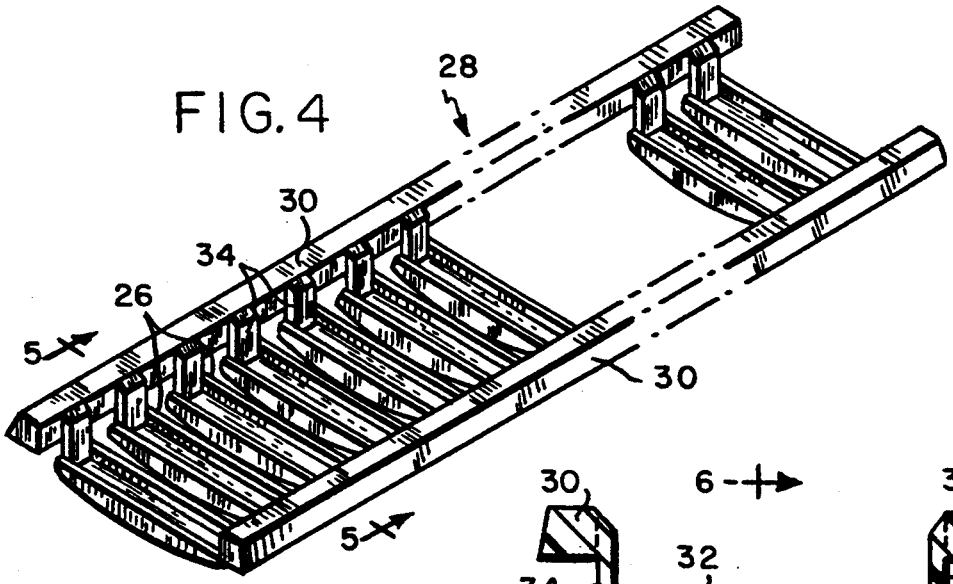
FIG. 4 is a perspective view of a molded framework in accordance with the present invention.
Figure 5:
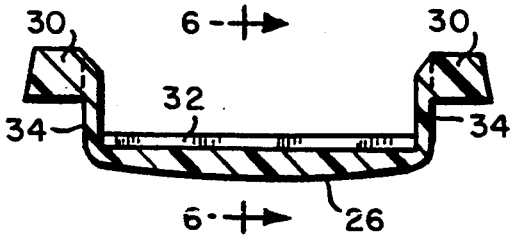
FIG. 5 is a sectional view on an enlarged scale taken along line 5—5 of FIG. 4.
Figure 6:
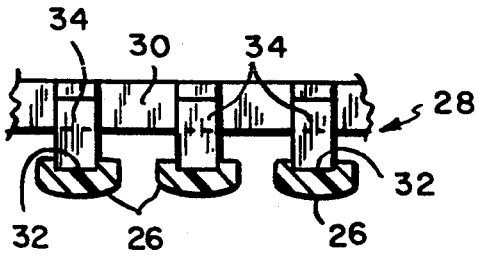
FIG. 6 is a sectional view taken along line 6—6 of FIG. 5.

In light of the foregoing, it will be appreciated by those skilled in the art that the method of the present invention is not limited to the forming and application of plastic top shells to metallic expansible watchbands. For example, the top shell framework 28 shown in FIG. 4 could, if desired, be formed as a metal casting or a metallic stamping. In the case of a metal casting, the top shells could be thicker and thus heavier, thereby contributing beneficially to the overall weight and feel of the finished product. In all cases, regardless of whether the framework is formed as a plastic molding, or a metallic casting or stamping, the individual top shells can be shaped differently one from the other and then readily applied as a group to the watchband linkage. The watchband linkage can either be of the expansible type, as shown in the illustrated embodiments, or it can be of the non-expansible type.

We claim:

1. A method of assembling top shells onto the links of a flexible linkage, said top shells being configured and dimensioned to overlie said links and having bendable end tabs, said method comprising the steps of:

forming an elongated framework which includes a plurality of said top shells arranged in an integrally interconnected parallel array;

combining a section of said linkage with said framework in a manner such that the links of said section are aligned with said top shells; and subdividing said framework to separate said top shells one from the other while deforming said end tabs around and into mechanical interengagement with the ends of said links to thereby secure said top shells to said links.

2. The method of claim 1 wherein said framework comprises a molding.

3. The method of claim 2 wherein said molding is of a non-metallic material.

4. The method of claim 3 wherein said non-metallic material is a plastic.

5. The method of claim 1 wherein said framework comprises a metallic stamping.

6. The method of claim 1 wherein said framework includes at least one side rail common to a plurality of said top shells and joined thereto at the end tabs thereof.

7. The method of claim 1 wherein said framework includes two parallel side rails with a plurality of said top shells extending transversely therebetween, and with opposite ends of said top shells being integrally joined to said side rails by said end tabs.

8. The method of either claims 6 or 7 wherein said framework is subdivided by severing said end tabs from the guide rails to which they are joined.

9. The method of claim 8 wherein the deformation of said end tabs occurs in conjunction with the severance thereof from said guide rails.

10. A method of assembling plastic top shells onto the metallic top links of an expansible watchband linkage, said top shells being configured and dimensioned to overlie respective top links of said linkage and having end tabs which are bendable around and into mechanical interengagement with respective ends of said top links, said method comprising the steps of:

a) molding an elongated plastic framework consisting of two parallel side rails with a plurality of said top shells extending transversely therebetween, the opposite ends of said top shells being integrally joined to said side rails by said end tabs;

b) arranging a section of said linkage between the side rails of said framework, with the top links of said linkage extending between the end tabs of respective top shells thereof; and c) severing said end tabs from said side rails and bendably deforming the thus severed end tabs around and into mechanical interengagement with the ends of respective top links.

11. The method of claim 10 wherein said top shells are molded with recesses on the undersides thereof, and wherein said top links are nested in said recesses prior to severing and bendably deforming said end tabs.

12. The method of claim 10 wherein the top shells are arranged in said framework in a laterally spaced relationship, and wherein said linkage is arranged between the side rails of said framework in an expanded condition to align said top links with said laterally spaced top shells.

13. The method of claim 10 wherein said end tabs are severed and bendably deformed by cutting blades coacting in opposed relationship and operating simultaneously on opposite sides of said framework.

14. The method of claim 10 wherein at least some of said top shells differ in appearance from other of said top shells within the same framework.

15. A method of assembling plastic top shells onto the metallic top links of an expansible watchband linkage, said top shells having recesses on the undersides thereof which are configured and dimensioned to receive respective top links of said linkage in nested relationship therein, and having end tabs which are bendable around and into engagement with respective ends of top links received in said recesses, said method comprising the steps of:

a) molding an elongated plastic framework consisting of two parallel side rails with a plurality of said top shells laterally spaced one from the other and extending transversely between said side rails, the opposite ends of said top shells being integrally joined to said side rails by said end tabs;

b) arranging a section of said linkage in an expanded condition between the side rails of said framework, with the top links of said linkage being nested in the recesses of respective top shells and extending between the end tabs thereof; and c) severing said end tabs from said side rails and bendably deforming the thus severed end tabs around and into engagement with the ends of respective top links.

* * * * *